US009834348B2

(12) United States Patent
Fox

(10) Patent No.: US 9,834,348 B2
(45) Date of Patent: Dec. 5, 2017

(54) CLOSURE

(75) Inventor: Jamie Fox, Norwich (GB)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 13/824,978

(22) PCT Filed: Sep. 12, 2012

(86) PCT No.: PCT/GB2012/000709
§ 371 (c)(1),
(2), (4) Date: Jan. 31, 2014

(87) PCT Pub. No.: WO2013/064790
PCT Pub. Date: May 10, 2013

(65) Prior Publication Data

US 2014/0138380 A1 May 22, 2014

(30) Foreign Application Priority Data

Oct. 31, 2011 (GB) ..... 1118822.4

(51) Int. Cl.

| | |
|---|---|
| ***B65D 51/24*** | (2006.01) |
| ***B65D 41/34*** | (2006.01) |
| ***B65D 41/56*** | (2006.01) |
| ***B65D 50/04*** | (2006.01) |

(52) U.S. Cl.
CPC ..... *B65D 51/24* (2013.01); *B65D 41/3457* (2013.01); *B65D 41/565* (2013.01); *B65D 50/046* (2013.01); *B65D 51/245* (2013.01); *B65D 2101/0007* (2013.01)

(58) Field of Classification Search
CPC ..... B65D 41/3457; B65D 51/24; B65D 2101/0007; B65D 41/56; B65D 50/046; B65D 41/565; B65D 51/245
USPC ..... 215/43, 216, 220, 228, 252, 230; 220/377
See application file for complete search history.

(56) References Cited

U.S. PATENT DOCUMENTS

| | | | | |
|---|---|---|---|---|
| 3,984,021 | A * | 10/1976 | Uhlig | 215/216 |
| 4,069,935 | A * | 1/1978 | Hampel | B65D 50/041 215/203 |
| 4,452,363 | A | 6/1984 | Davis | |
| 5,219,084 | A * | 6/1993 | King | B65D 1/02 215/220 |
| 2004/0007555 | A1* | 1/2004 | Steele et al. | 215/228 |
| 2008/0142469 | A1 | 6/2008 | Zeligson | |

FOREIGN PATENT DOCUMENTS

| | | | |
|---|---|---|---|
| DE | 10155578 | A1 | 5/2003 |
| GB | 2262280 | A | 6/1996 |
| WO | 2006085779 | A1 | 8/2006 |
| WO | 2008068787 | A1 | 6/2008 |
| WO | 2001094378 | A1 | 8/2011 |

OTHER PUBLICATIONS

European Patent Office, International Search Report and Written Opinion of PCT/GB20121000709, Nov. 23, 2012, 9 pages.

* cited by examiner

*Primary Examiner* — James N Smalley
(74) *Attorney, Agent, or Firm* — McCoy Russell LLP

(57) ABSTRACT

A closure for a container comprises tamper-evident means for indicating if the closure has been removed from the container. The tamper-evident means is provided within the interior of the closure.

12 Claims, 13 Drawing Sheets

SECTION B-B

SECTION A-A

CLOSURE

CROSS-REFERENCE TO RELATED APPLICATIONS

The present application is the U.S. National Phase of International PCT Application Serial No. PCT/GB2012/000709, entitled "A Closure," filed Sep. 12, 2012, which claims priority to Great Britain Application No. 1118822.4, filed Oct. 31, 2011, each of which are hereby incorporated by reference in their entirety for all purposes.

The present invention relates generally to a closure and particularly, although not exclusively, to a dosing closure for a container.

Dosing closures are well known and used, for example, in household applications such as mouthwash and detergents. In many cases it is advantageous if a visual distinction between opened and unopened closures is provided. There are known methods for providing tamper-evidence on oral care mouthwash closures, the most common being shrink sleeves, paper tabs and tamper-evident drop bands. Current drop band-based solutions use a band connected at the open end of the closure by frangible bridges; when the closure is opened the bridges break and allow the band to fall. This can lead to sharp edges in the area intended to be placed to the lips during use as a dosing cup.

According to the present invention there is provided a closure for a container, the closure comprising tamper-evident means (e.g., a tamper-evident indicator) for indicating if the closure has been removed from the container, in which the means may be provided within the interior of the closure.

The tamper-evident means therefore can be adapted to activate upon first opening of the closure to provide, for example, a visually distinct appearance of the closure.

Upon first opening at least part of the means may be retained within the interior of the closure.

For example, by having a tamper-evident feature up inside a cap body this can be used to provide an open end with a smooth finish even after opening.

In some embodiments the closure may include a side wall or skirt and at least part of the tamper-evidencing feature may be carried on or by the interior of the skirt, for example spaced from the free end of the skirt.

The tamper-evident means may include two or more separable parts and, for example, may include a frangible connection.

The means may comprise or include a tamper evident band, such as a tamper-evident drop band. The means may comprise a band having first and second tamper-evident annuli frangibly connected together and adapted to split apart from each other upon first opening.

The closure may include one or more markings to indicate fill levels, such as lines or other indicia. At least part of the tamper-evident means may be aligned with a marking after opening. This could be used, for example, to give part of the means a dual function.

The closure may comprise a body which may be generally frustoconical. The body may include a top plate and a side wall. The top plate may be generally circular and the side wall may be generally cylindrical (and may include a degree of conicity).

At least part of the body may be non-opaque. This is particularly useful with tamper-evident means provided within the interior of the closure so that part or all of the means is visible, for example before/after opening. At least part of the body may be transparent. At least part of the body may be translucent.

The closure may further comprise child-proofing means. The enclosure may therefore comprise a tamper-evident, child-proof dosing closure. In this respect the closure may be formed as a squeeze-and-turn and/or a push-and-turn closure. The child-proofing features may comprise, for example, lugs, fins and the like. The tamper-evident means may be located so that it does not interfere with the child-proofing mechanism. For example, by locating the tamper-evident means away from the free end of a closure the child-proofing means can be located there.

At least part of the tamper-evident means may be retained on a container after first opening. For example, part of the tamper-evident means may be released from the closure so that it drops onto the container.

The closure may include surface formations, such as screw threads, snap beads and the like, for engaging a container.

The closure may be formed as a dosing closure. For example the closure may include one or more markings or other indicia to indicate one or more fill levels.

The closure may be formed as a mouthwash closure. Other suitable applications for the closure are possible.

The present invention also provides a closure as described herein in combination with a container.

Different aspects of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

The present invention will now be more particularly described, by way of example, with reference to the accompanying drawings, in which.

Figure 1:
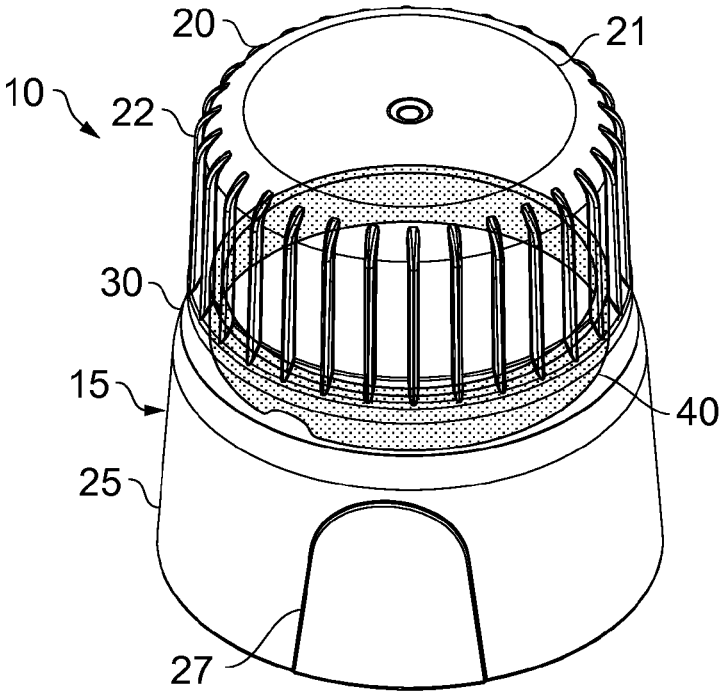
FIG. 1 is a perspective view of a closure formed according to an embodiment of the present invention.
Figure 2:
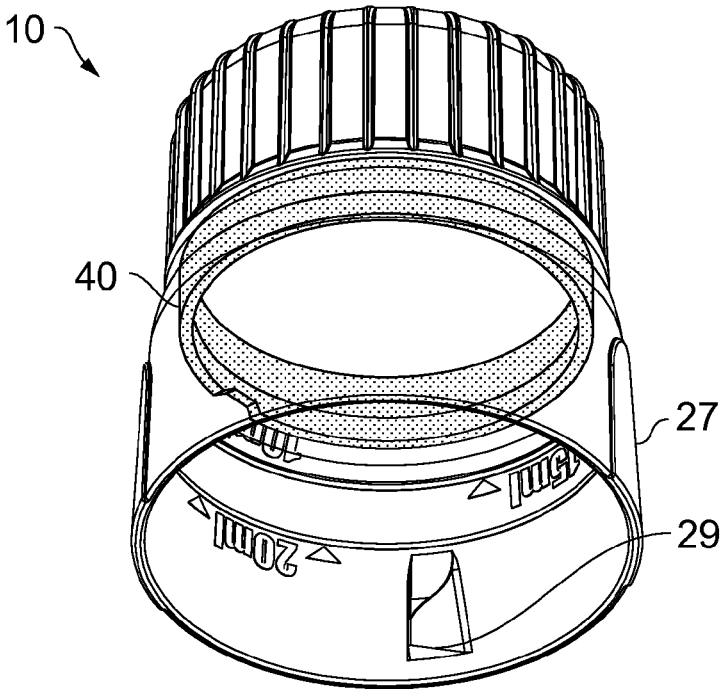
FIG. 2 is a further perspective view of the closure of FIG. 1.
Figure 3:
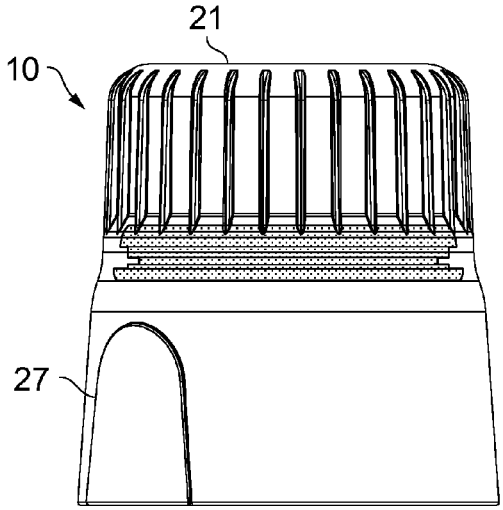
FIG. 3 is a side elevation of the closure of FIG. 1.
Figure 4:
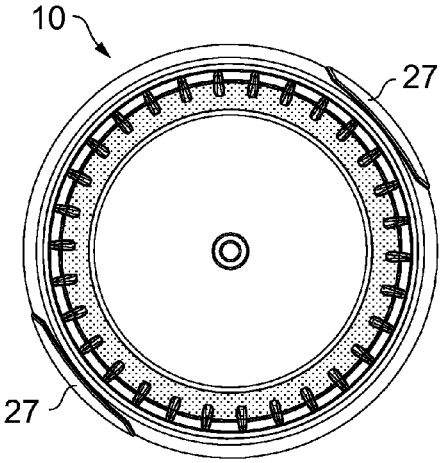
FIG. 4 is a plan view of the closure of FIG. 1.
Figure 5:
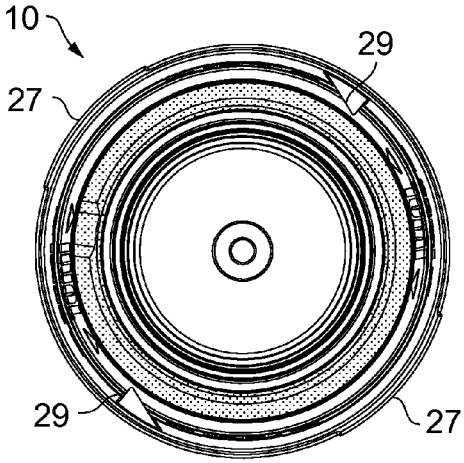
FIG. 5 is an underplan view of the closure of FIG. 1.
Figure 6:
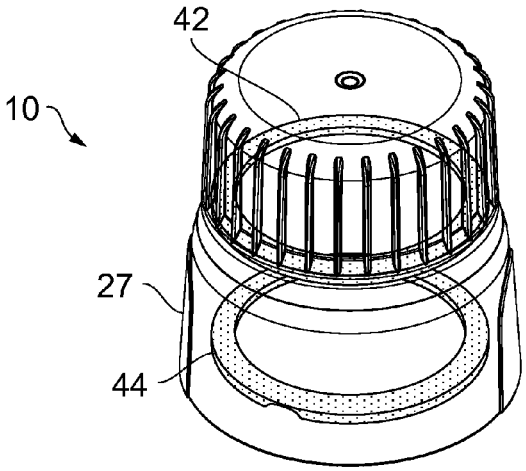
FIG. 6 is a perspective view of the closure of FIG. 1 shown following activation of a tamper-evident drop band.
Figure 7:
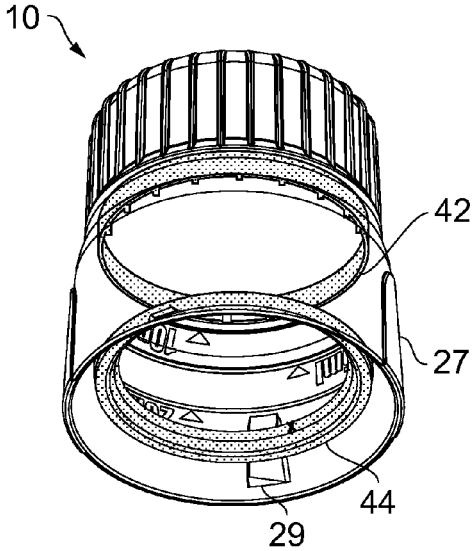
FIG. 7 is an underplan perspective view of the closure of FIG. 2 following activation of the drop band.
Figure 8:
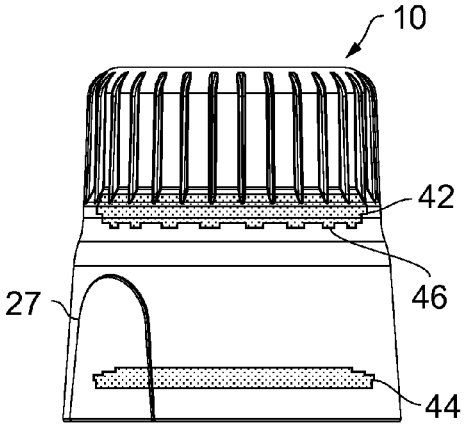
FIG. 8 is a side elevation of the closure of FIG. 3 following activation of the drop band.

Referring first to FIGS. 1 to 5 and 9 there is shown a closure generally indicated 10. The closure 10 comprises a generally frustoconical body 15 comprising a cup-shape top cap 20 at one end and a flared skirt 25 at the other and joined to the cap 20 by a waist 30. The body is formed from a transparent plastics material.

The cap 20 comprises a circular top plate 21 and a cylindrical side wall 22 depending from the periphery of the plate 21. The interior surface of the side wall 22 is provided with screw thread formations 23.

The waist 30 comprises an interior annular recess 31 including a ledge 32 which merges into the skirt 25.

The skirt 25 extends from the waist 30 and flares slightly outwardly towards its open end 26. The exterior of the skirt 25 carries a pair of diametrically opposed pressing pads 27. The skirt 25 also includes two annular projections 28*a*, 28*b* which are labelled and function as fill lines. The interior of the skirt 25 is also provided with a pair of opposed lugs 29 which are positioned diametrically opposite each other and offset by ninety degrees to each of the pressing pads 27.

The closure 10 is provided with a tamper-evident band arrangement 40. The arrangement 40 comprises an upper annulus 42 and a lower annulus 44 joined together by a plurality of frangible bridges 46. The upper annulus 42 is generally wedge-shaped and is received in the body recess 31 so that it clips into the recess and is retained by the ledge 32 as shown best in FIG. 9. The lower annulus 44 is locked under a neck locking bead 53.

Figure 9:
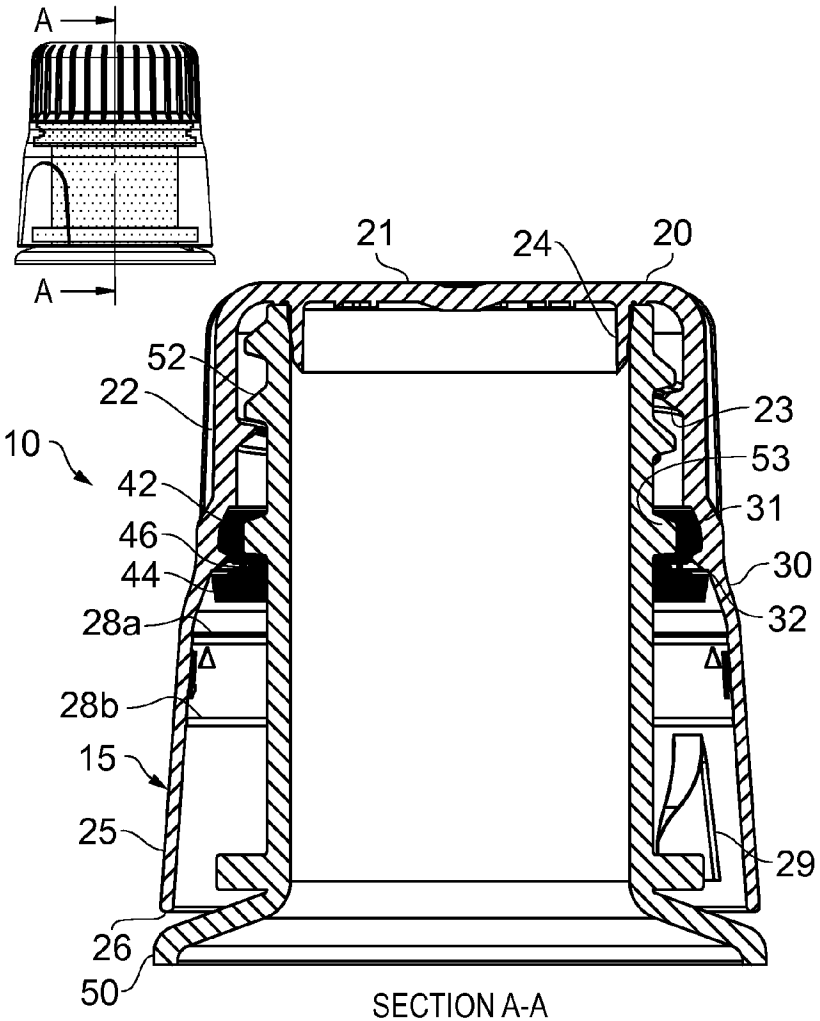
FIG. 9 is a section of the closure of FIGS. 1 to 5 prior to activation of the drop band.
Figure 11:
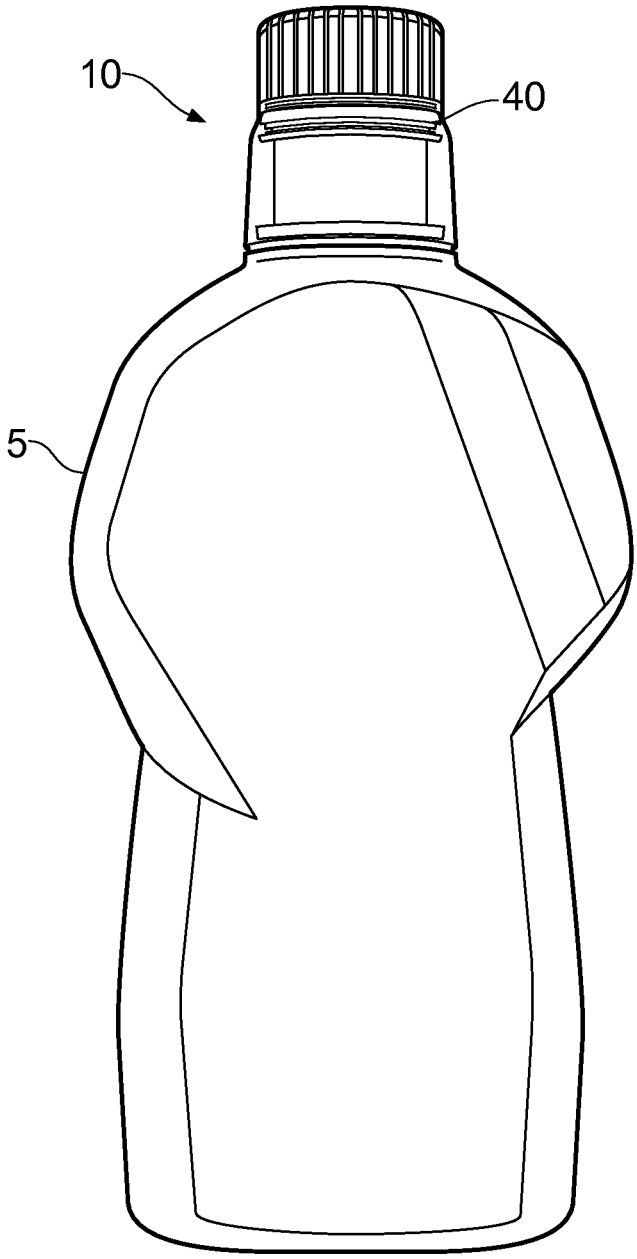
FIG. 11 is a side elevation of the closure of FIGS. 1 to 5 and 9 shown attached to a container.

In use the closure 10 is applied to the neck 50 of a container 5 as shown best in FIGS. 9 and 11. The screw thread formations 23 engage corresponding formations 52 on the neck and the wedge-like locking lugs 29 engage corresponding locking lugs (not shown) on the neck. The top plate 21 includes an annular ceiling plug 24 which depends from its underside and fits within the bore of the container neck mouth.

Figure 10:
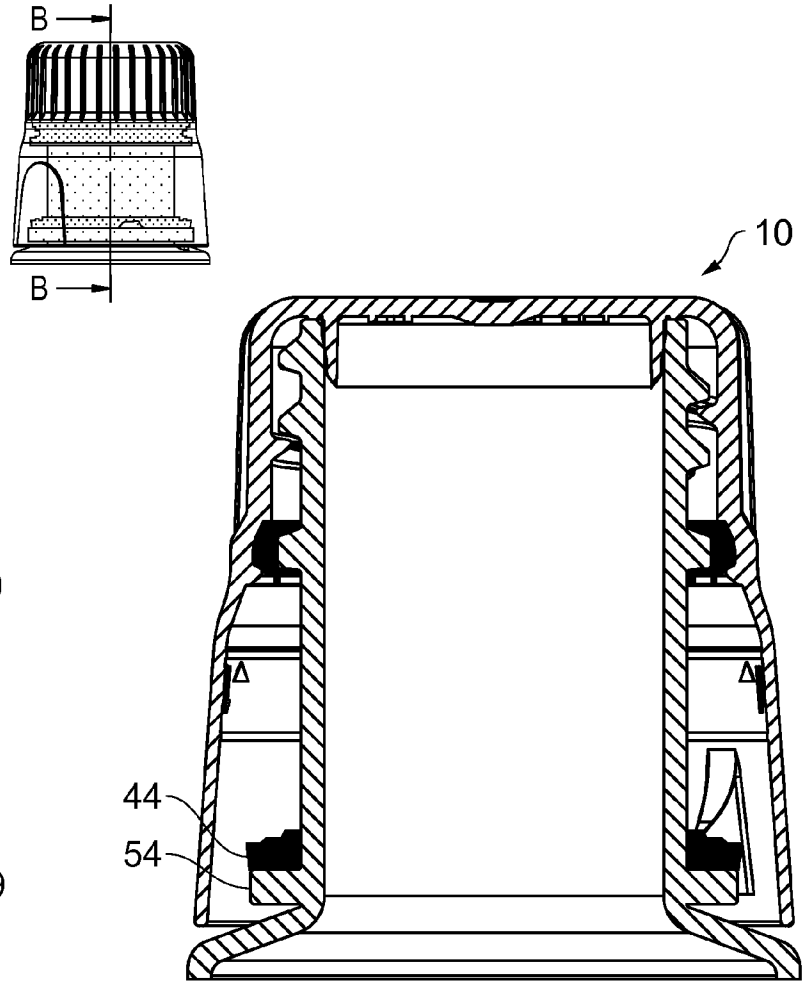
FIG. 10 is a section of the closure of FIGS. 6 to 8 following activation of the drop band.

In order to remove the closure 10 from the container neck 50 the pressing pads 27 are depressed which ovalises the skirt 25 and causes the lugs 29 to be deflected outwardly and clear of the neck lugs. This allows the closure to be unscrewed and in doing so the frangible bridges 46 are caused to break under the lower annulus 44, such that the lower annulus 44 is released and drops down so that it rests on the container neck transfer bead 54 as shown best in FIG. 10.

The closure 10 can now be removed with the upper annulus 42 retained in the recess 31 and the lower annulus 44 retained on the container neck. In this position the upper annulus 42 is indicative of a further fill line. After opening the closure for the first time, therefore, the remaining portion of the coloured tamper ring is set at a height that provides a very clear, obvious level line for a consumer to use when dosing the product.

Figure 12:
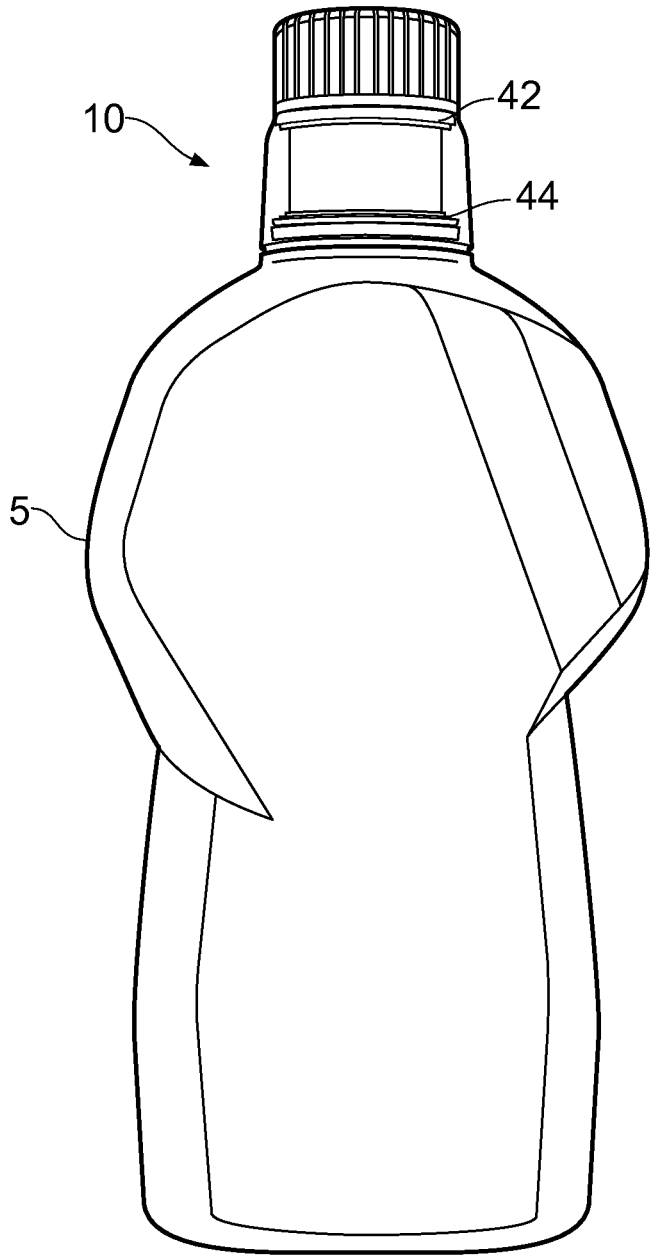
FIG. 12 is a side elevation of the closure of FIGS. 6 to 8 and 10 after an opening event.
Figure 13:
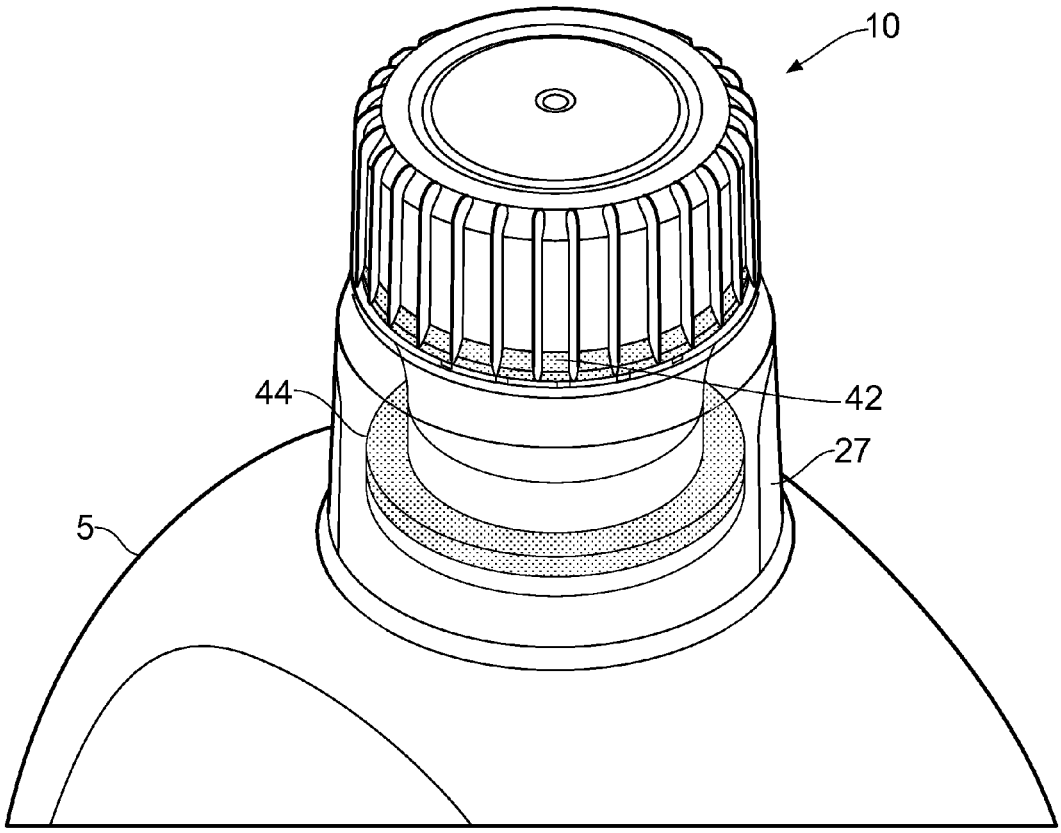
FIG. 13 is a magnified perspective view of the closure and container of FIG. 12.

When the closure is replaced as shown in FIGS. 12 and 13 the band arrangement 40 is clearly shown to be separated into the upper and lower annuli.

Because the annulus 44 is retained on the bead 54 it does not interfere with subsequent removal of the closure involving depression of the pads 27. In other words, because the tamper evidence is internal, when the closure is squeezed for the first time to undo the child-resistant feature the band does not get in the way of the functionality of the child resistance. Current child-resistant closures that require squeezing in order to open and that have tamper-bands at the bottom are difficult to use as the TE band restricts the squeeze. Having the band internally and away from the bottom of the closure means that the band does not restrict the squeeze.

Figure 14:
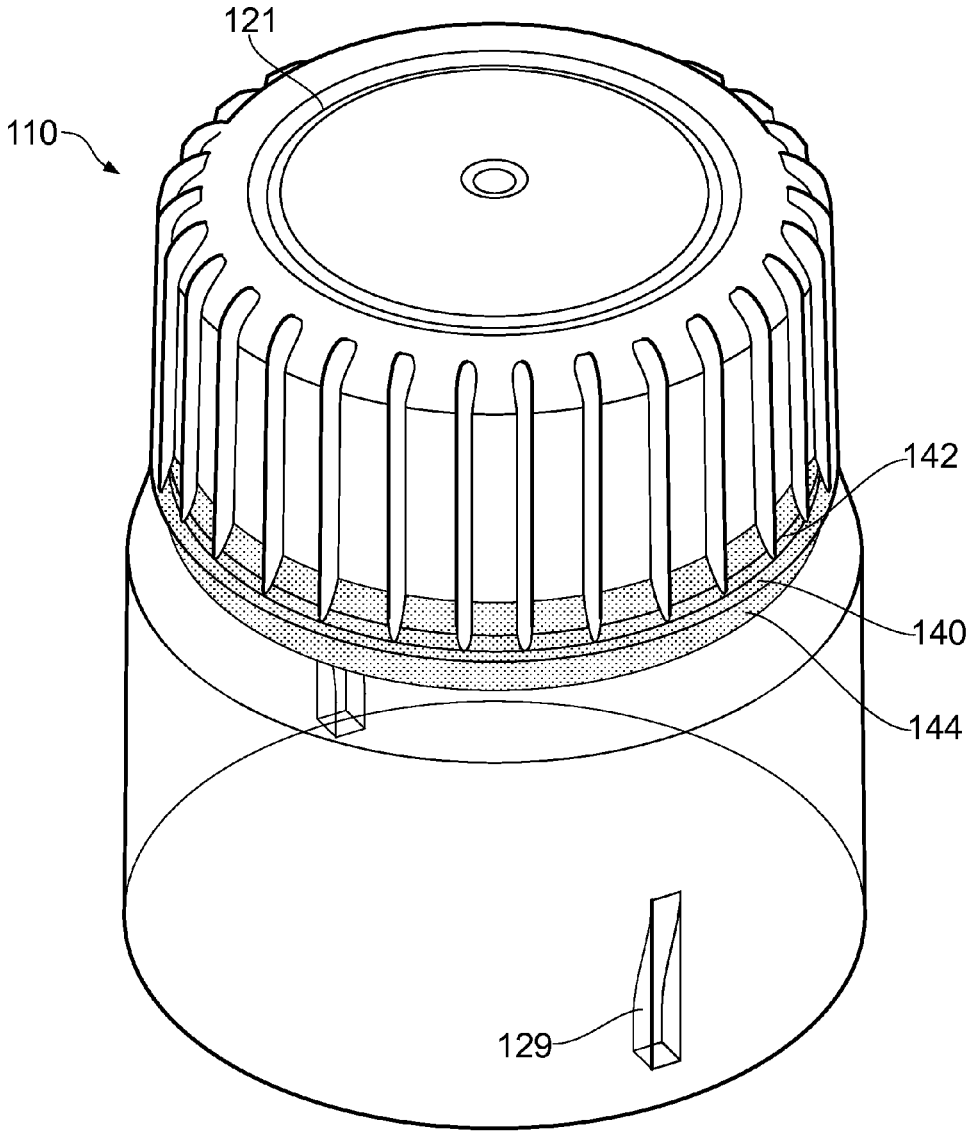
FIG. 14 is a perspective view of a closure formed according to an alternative embodiment and shown before application to a container neck.
Figure 15:
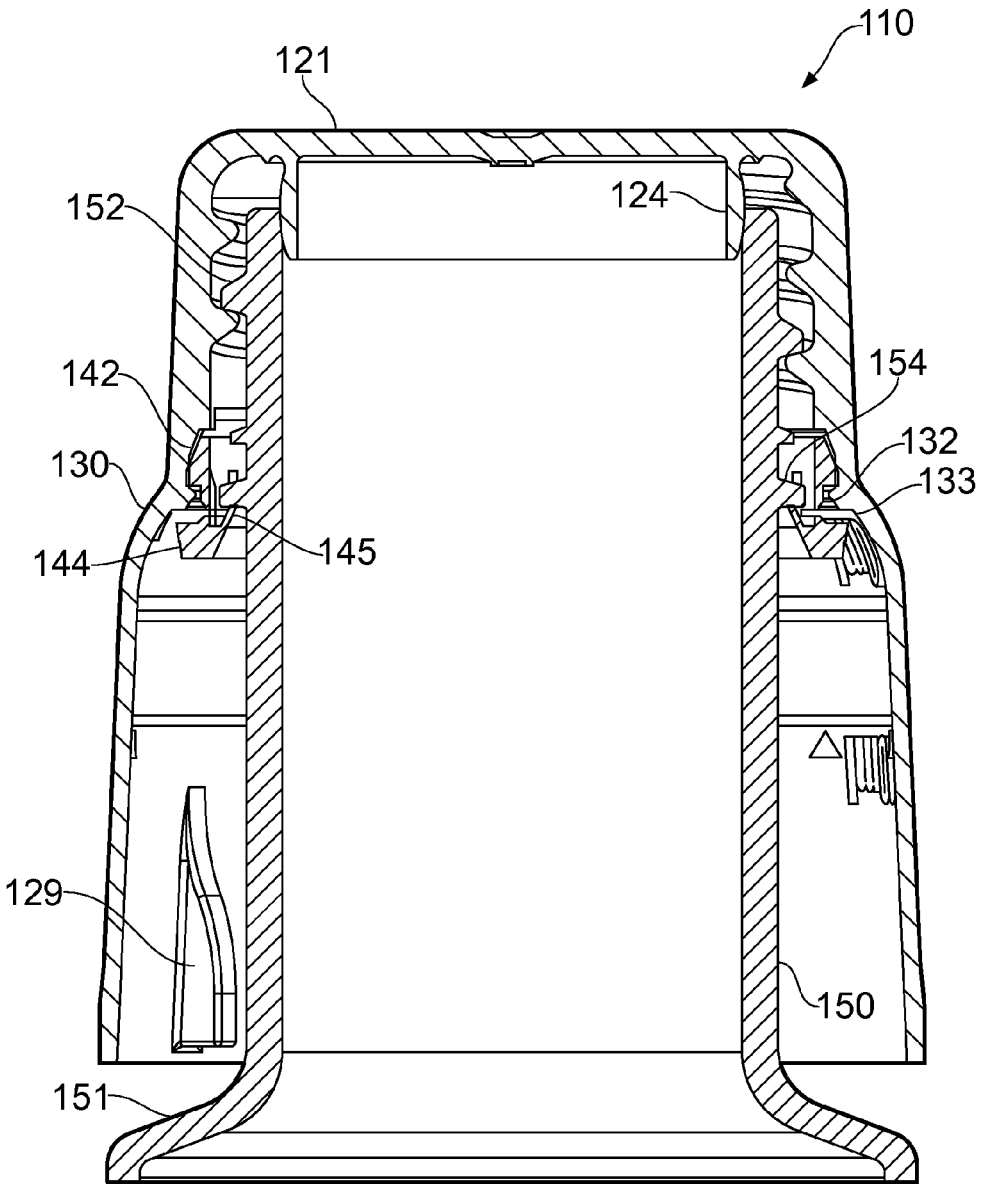
FIG. 15 is a section of the closure of FIG. 14 shown fitted to a container.

Referring now to FIGS. 14 and 15 there is shown a closure 110 formed according to an alternative embodiment. The closure 110 is very similar to the closure 10, with one difference being that the waist 130 is less pronounced. Furthermore, the lower ring annulus 144 is shown to have a radially inclined flap 145 which projects from the inner, upper corner.

In use the double ring tamper-evident band 140 is first fitted into the closure body so that the upper band 142 clips over the closure bead 132 at the 10 ml fill line 133.

Thereafter the closure 110 can be screwed down onto the container neck 150. The lower ring flap 145 can flex and pass over the neck screw threads 152. When the closure is fully screwed on to the neck the flap locks under the neck transfer bead 154. In this embodiment the transfer bead on the neck is used, but in other embodiments the band could also be used with a purpose made tamper-evident bead on the neck.

Figure 16:
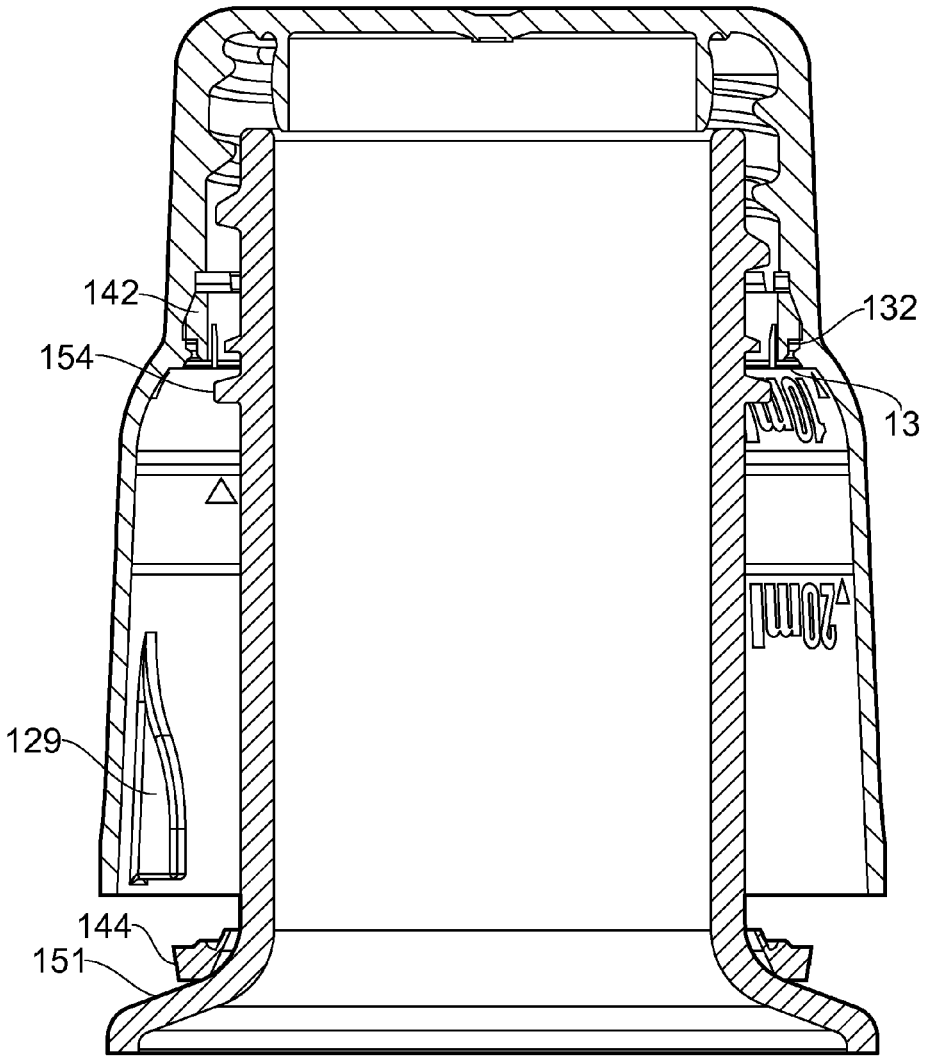
FIG. 16 is a section of the closure of FIG. 15 shown during first opening.

As shown in FIG. 16, when the closure 110 is unscrewed for the first time the lower ring 144 cannot move up because the flap is locked under the transfer bead. Therefore the bridges 146 are broken and the two rings 142, 144 get pulled apart, with the upper ring 142 remaining clipped into the closure. The lower ring 144 falls down and rests on the neck shoulder 151 (there is no ring 54 in this embodiment).

Figure 17:
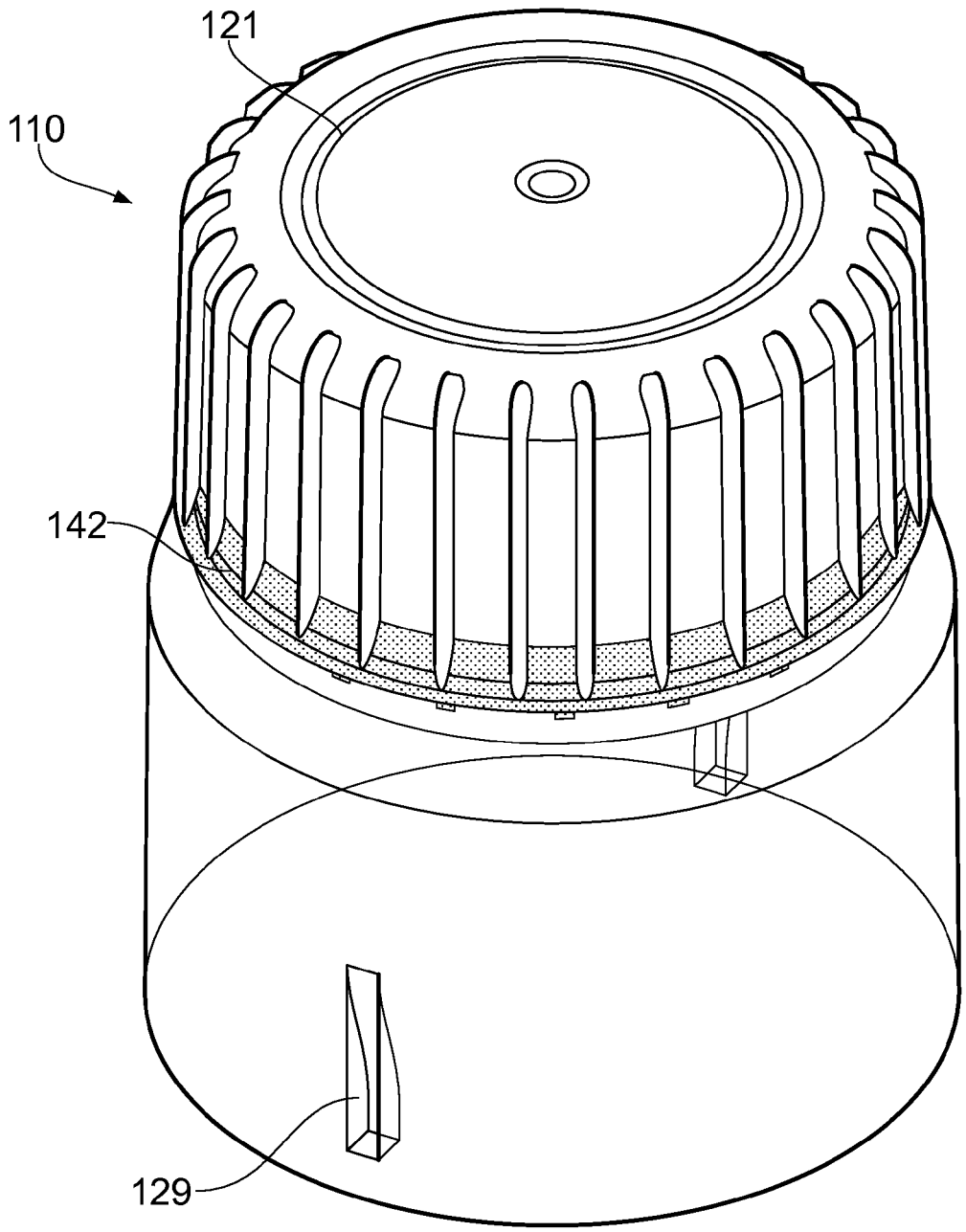
FIG. 17 is a perspective view of the closure of FIG. 16 shown removed from the container.
Figure 18:
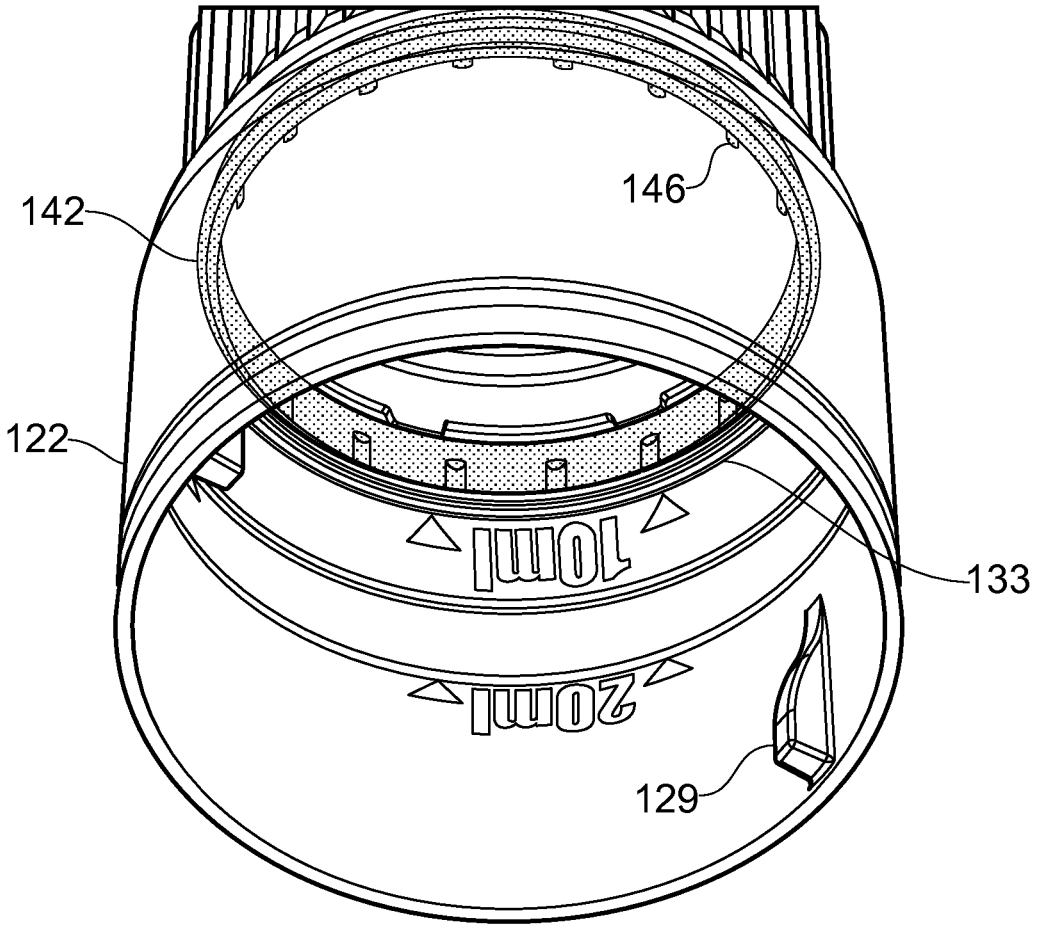
FIG. 18 is an underplan perspective view of the closure of FIG. 17.

The closure 110 is shown removed in FIGS. 17 and 18, with just the upper ring 142 retained and visible through the closure body (which in this embodiment is translucent). The ring section 142 is shown to be in register with the 10 ml fill line.

Figure 19:
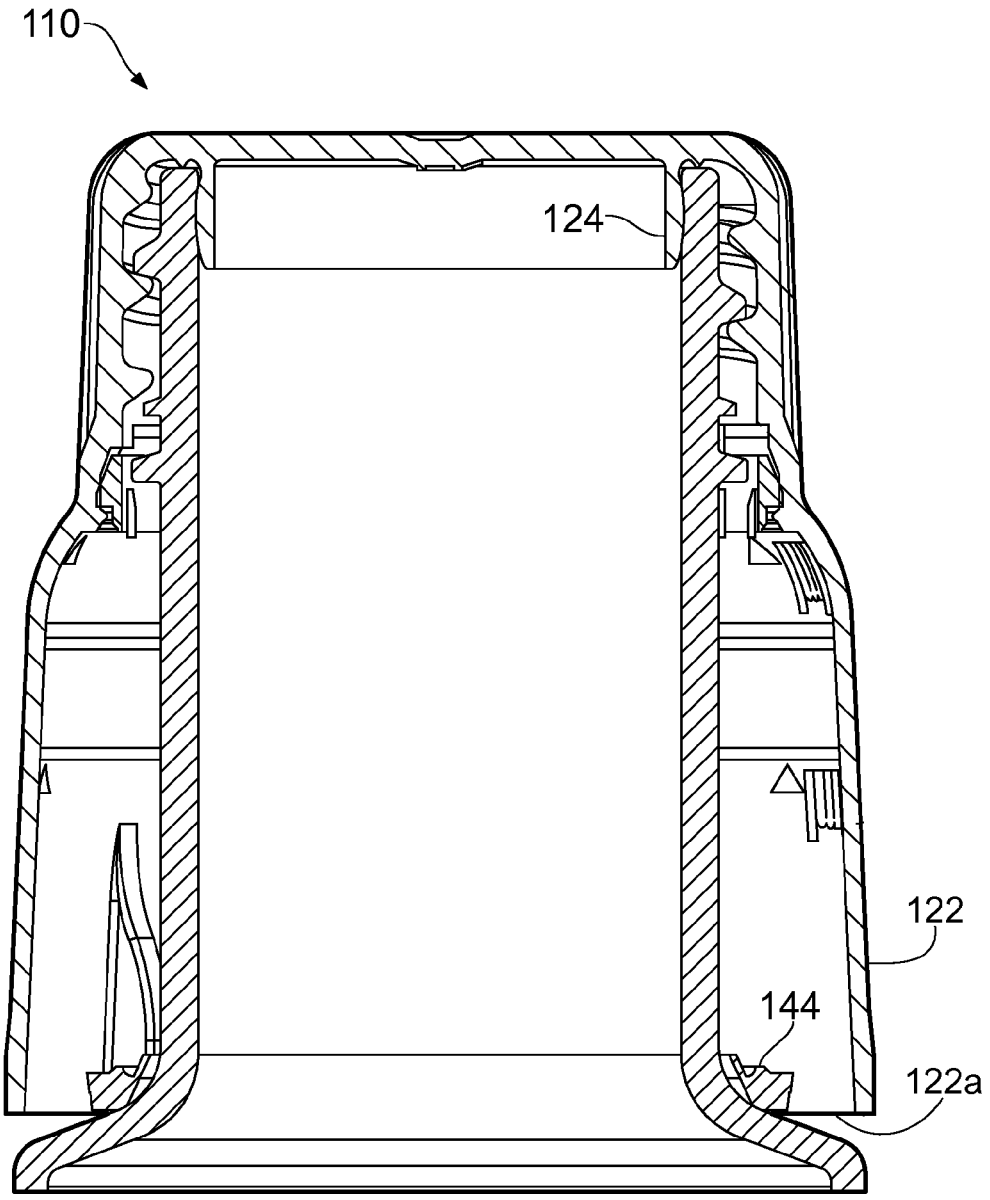
FIG. 19 is a section of the closure of FIG. 17 shown re-fitted onto the container.

As shown in FIG. 19, when the closure 110 is replaced it is screwed fully back onto the neck so that the plug 124 engages into the neck mouth and the lugs 129 re-engage over the corresponding formations on the neck finish. The ring 144 remains on the neck shoulder 151 and in this embodiment the lower edge of the ring lies generally in line with the open end 122*a* of the closure body skirt 122.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A tamper-evident closure for a container, the closure comprising a body having a tamper-evident indicator for indicating if the closure has been removed from the container, the indicator being provided within an interior of the body, at least part of the body being non-opaque such that at least part of the indicator is visible through the body after a first opening of the closure, in which the indicator comprises a tamper-evident band, the band comprising a first annulus and a second annulus, the first and second annuli being frangibly connected together, wherein upon the first opening of the closure, the first and second annuli are split apart from each other, the first annulus being retained within the interior of the body so it is visible through the at least part of the body which is non-opaque and the second annulus being released as an annulus and dropping onto the container and retained on the container as an annulus.

2. The closure as claimed in claim 1, wherein the tamper-evident indicator is attached to a sidewall of the body within the interior of the body in an unopened state of the closure.

3. The closure as claimed in claim 2, in which upon the first opening all of the indicator remains within the interior of the body.

4. The closure as claimed in claim 1, in which the body is generally frustoconical.

5. The closure as claimed in claim 1, in which the body includes a top plate and a sidewall.

6. The closure as claimed in claim 1, in which at least part of the body is transparent.

7. The closure as claimed in claim 1, in which at least part of the body is translucent.

8. The closure as claimed in claim 1, in which the closure further comprises child-proofing means.

9. The closure as claimed in claim 1, in which the closure is formed as a squeeze-and-turn closure.

10. The closure as claimed in claim 1, in which both of the first and second annuli remain within, and are visible through, the body upon the first opening.

11. The closure as claimed in claim 1, in which the body includes one or more markings to indicate fill levels, and wherein at least part of the indicator is aligned with one of the markings.

12. The closure as claimed in claim 1, wherein the body has a top plate and a skirt depending therefrom, the tamper-evident indicator being attached to the skirt within the interior of the body at a position intermediate the top plate and a free end of the skirt in an unopened state of the closure.

* * * * *